US005956010A

United States Patent [19]

Asao et al.

[11] Patent Number: 5,956,010

[45] Date of Patent: Sep. 21, 1999

[54] LIQUID CRYSTAL APPARATUS AND DRIVING METHOD

[75] Inventors: Yasufumi Asao, Isehara; Yasuaki Takeda, Chigasaki; Hirohide Munakata, Yokohama; Yukio Hanyu, Isehara; Nobuhiro Ito, Sagamihara, all of Japan

[73] Assignee: Canon Kabushiki Kaisha, Tokyo, Japan

[21] Appl. No.: 08/866,112

[22] Filed: May 30, 1997

[30] Foreign Application Priority Data

May 31, 1996 [JP] Japan ..... 8-138143

[51] Int. Cl.[6] ..... G09G 3/36

[52] U.S. Cl. ..... 345/94; 345/95; 345/103

[58] Field of Search ..... 345/87, 94, 95, 345/98, 99, 103, 104, 105

[56] References Cited

U.S. PATENT DOCUMENTS

| | | | |
|---|---|---|---|
| 4,367,924 | 1/1983 | Clark et al. | 350/334 |
| 4,923,285 | 5/1990 | Ogino et al. | 350/331 T |
| 5,082,587 | 1/1992 | Janulis | 252/299.01 |
| 5,109,294 | 4/1992 | Hanyu et al. | 359/83 |
| 5,293,544 | 3/1994 | Hanyu et al. | 359/78 |
| 5,317,332 | 5/1994 | Kanno et al. | 345/101 |
| 5,506,601 | 4/1996 | Mihara et al. | 345/103 |
| 5,523,872 | 6/1996 | Hanyu et al. | 359/78 |
| 5,691,740 | 11/1997 | Onitsuka et al. | 345/96 |
| 5,856,814 | 1/1999 | Yagyu | 345/89 |

FOREIGN PATENT DOCUMENTS

| | | |
|---|---|---|
| 0740185 | 10/1996 | European Pat. Off. . |
| 56-107216 | 8/1981 | Japan . |
| 59-193426 | 11/1984 | Japan . |
| 59-193427 | 11/1984 | Japan . |
| 60-156046 | 8/1985 | Japan . |
| 60-156047 | 8/1985 | Japan . |
| 5273537 | 10/1993 | Japan . |
| 7056176 | 3/1995 | Japan . |
| WO9322390 | 11/1993 | WIPO . |

OTHER PUBLICATIONS

A.D.L. Chandani et al., "Tristable Switching in Surface Stabilized Ferroelectric Liquid Crystals with a Large Spontaneous Polarization", Japanese Journal of Applied Physics, vol. 27, No. 5, May 1988, pp. L729–L732.

*Primary Examiner*—Richard A. Hjerpe
*Assistant Examiner*—Vanel Frenel
*Attorney, Agent, or Firm*—Fitzpatrick, Cella, Harper & Scinto

[57] ABSTRACT

A liquid crystal apparatus is constituted by a liquid crystal device including a pair of substrates and a liquid crystal disposed between the substrates, and means for applying an asymmetrical drive signal waveform to the liquid crystal. The liquid crystal is capable of having at least two stable states S1 and S2 and capable of causing a cumulative translational movement depending on a change in an external electric field applied to the liquid crystal. To the liquid crystal, an asymmetrical drive signal waveform having an effective frequency range is applied by the above application means so as to provide an absolute value of a difference between an inversion frequency $f_{01}$ where a direction of the movement of said liquid crystal is turned in an opposite direction in the state S1 and an inversion frequency $f_{02}$ where a direction of the movement of said liquid crystal is turned in an opposite direction in the state S2 smaller than a difference therebetween in the case of applying a symmetrical drive signal waveform to said liquid crystal. The inversion frequencies $f_{01}$ and $f_{02}$ are within the effective frequency range of the asymmetrical drive signal waveform. The application means is effective in suppressing liquid crystal movement in the liquid crystal device.

14 Claims, 9 Drawing Sheets

(S1) (S2)

(WAVEFORM A)

(WAVEFORM B)

(WAVEFORM C)

(WAVEFORM D)

(WAVEFORM E)

LIQUID CRYSTAL APPARATUS AND DRIVING METHOD

FIELD OF THE INVENTION AND RELATED ART

The present invention relates to a liquid crystal apparatus including a liquid crystal device which may be used as a display device for a television receiver, a view finder for a video camera or a terminal monitor for a computer, or a light valve for a liquid crystal printer, a projector, etc., and a drive method of such a liquid crystal device. Particularly, the present invention relates to a liquid crystal apparatus using a chiral smectic liquid crystal excellent in durability and reliability.

A liquid crystal display device of a passive matrix drive-type using a TN (twisted nematic) liquid crystal has been known as a device which can be produced at a relatively low cost. However, the passive matrix-drive type liquid crystal device using a TN-liquid crystal has a certain limitation due to the occurrence of a crosstalk or a lowering in contrast along with the increase in number of drive lines so that it cannot be said to be suitable as a display device requiring a high resolution and a large number of drive lines, e.g., a liquid crystal television panel.

As a type of liquid crystal device having solved such a fundamental problem of a conventional TN-liquid crystal device, there has been proposed a surface-stabilized ferroelectric liquid crystal device (SSFLCD) by Clark and Lagerwall (Japanese Laid-Open Patent Application (JP-A) 56-107216 corr. to U.S. Pat. No. 4,367,924). In the surface-stabilized ferroelectric liquid crystal device, a liquid crystal showing a chiral smectic phase, such as chiral smectic C (SmC*) phase or chiral smectic H (SmH*) phase, in its operational state is sandwiched between a pair of substrates with a small cell gap to exhibit a polarization domain intrinsic to a ferroelectric material, thus realizing a high-speed responsiveness and bistability. In other words, the SSFLCD is one of chiral smectic liquid crystal devices. In the SSFLCD, chiral smectic liquid crystal molecules show bistability, i.e., a property of assuming two stable states and thus do not readily settle into an intermediate molecular position.

By providing a liquid crystal device utilizing a switching of liquid crystal molecules between such bistable states (two stable states), there has been made a considerably essential improvement on many problems of a liquid crystal device using a conventional twisted nematic (TN) liquid crystal. Further, by using the SSFLCD together with polarizers in combination, the SSFLCD is expected to be widely used as a display device showing a high-speed responsiveness and a memory characteristic.

In recent years, there has been also proposed a chiral smectic anti-ferroelectric liquid crystal. device assuming three stable states (Chandani, Takezoe et al.; Japanese Journal of Applied Physics, Vol. 27, pp. L729–L732 (1988)).

As a driving method of the SSFLCD described above, a simple matrix-addressed drive scheme utilizing a memory characteristic is generally used. According to this scheme, in the SSFLCD, a plurality of scanning electrodes and a plurality of data electrodes are arranged in a matrix form. Specifically, a scanning signal is successively applied to the scanning electrodes in synchronism with application of a data signal to associated data electrodes.

In the case where the above-mentioned liquid crystal device (SSFLCD) is driven by using such a simple matrix-addressed drive scheme, a data signal determining a display state is applied to data electrodes and a scanning signal designating a writing time (writing period) is successively applied to scanning electrodes. A display state of each pixel in a selection period is determined in accordance with a combined (composite) signal of the scanning signal and the data signal. On the other hand, in a non-selection period, each pixel is always affected by a change in electric field due to a data signal application.

Liquid crystal molecules minutely vibrate on a cone (a cone-shaped plane on which liquid crystal molecules can be placed) within a degree not causing inversion by the interaction between the constantly varying electric field and a spontaneous polarization of liquid crystal molecules, so that it has been clarified that a translational movement (uniform motion in one line or direction) of a center of gravity of liquid crystal molecules is induced. More specifically, as shown in FIG. 1 each of liquid crystal molecules assumes either one of two stable states S1 and S2. The liquid crystal molecule in the S1 state is moved in, e.g., a direction 02 and the liquid crystal molecule in the S2 state is moved in, e.g., a direction 03. These directions 02 and 03 are perpendicular to a direction 01 of a uniaxial aligning treatment (e.g., rubbing) axis, i.e., are parallel to a longitudinal direction of the liquid crystal molecular layers.

Due to the cumulative translational movement described above, the liquid crystal sandwiched between the substrates is accumulated at a peripheral portion of the device or an end portion of an effective optical modulation region (writing region) to increase a cell thickness (a thickness of the liquid crystal layer) at the portion. As a result, a retardation in the liquid crystal layer is increased, thus shifting a wavelength distribution of a transmitted light to a wavelength range assuming yellow (called "yellowing (phenomenon)"). Due to this yellowing phenomenon resulting from a change in transmitted light spectrum, a display quality is lowered. In case where an amount of the increase in cell thickness decreased above becomes large, an effective electric field applied to the liquid crystal is lowered to cause a display unevenness within the effective optical modulation region (writing region).

In order to minimize or suppress the above-described liquid crystal movement, there have been proposed several methods including: one utilizing a cell thickness-dependence of a liquid crystal movement degree (JP-A 7-56176), one utilizing a surface shape-dependence based on an uneven surfaced substrate (JP-A 5-273537), and one wherein an alignment state of a liquid crystal is changed correspondingly depending on a region (European Patent Application Publication No. 0740185 A2). In these methods, structural members or structural factors of a liquid crystal cell have been modified or controlled to solve the problem of liquid crystal movement.

However, according to our study, it has been clarified that a direction and/or degree of a liquid crystal movement is inverted or changed by changing not only the structural members (factors) but also a liquid crystal material or driving conditions of a liquid crystal device, such as a drive temperature, a drive frequency and a drive voltage. It has also clarified that a predominant factor in determining a direction of the liquid crystal movement is a drive frequency.

Herein, a frequency at which the direction of the liquid crystal movement is inverted (or a rate of the liquid crystal movement becomes zero) is referred to as "inversion (or zero-crossing) frequency".

It is possible to provide a liquid crystal apparatus including a liquid crystal device free from the liquid crystal movement by driving the liquid crystal device at an inversion (zero-crossing) frequency.

However, according to our further study, it has been confirmed that a direction and/or degree of the liquid crystal movement at the time of writing an S1 state (as shown in FIG. 1) is different from that at the time of writing an S2 state (as shown in FIG. 1) in some cases when a pair of substrates is not symmetrical with respect to a cell structure or when applied signal waveforms for providing (writing) S1 and S2 states are not symmetrical with respect to a reference line representing a voltage value of zero. In other words, it has been found that inversion frequencies for S1 and S2 states can be mutually different from each other. Herein, the term "S1 (S2) state" covers not only a state wherein liquid crystal molecules are placed in S1 (S2) state by electric field application but also a state wherein such liquid crystal molecules once placed in the S1 (S2) state remain in the S1 (S2) state (i.e., a memory state at the S1 (S2) position) under no electric field application, unless otherwise noted.

With respect to such S1 and S2 states, when liquid crystal movement characteristics at the time of writing S1 and S2 states are different from each other, it becomes difficult to optimize the different (two) liquid crystal movement characteristics (for S1 and S2 states) at the same time. As a result, it becomes very difficult to design a liquid crystal cell (device) wherein the liquid crystal movement is suppressed or alleviated.

Accordingly, in order to suppress the liquid crystal movement, a liquid crystal cell (device) is required to be designed so as to control a difference in inversion frequency between the S1 and S2 states as small as possible.

SUMMARY OF THE INVENTION

In view of the above-mentioned circumstances, an object of the present invention is to provide a liquid crystal apparatus including a liquid crystal device, particularly a chiral smectic liquid crystal device, in which a liquid crystal movement phenomenon is suppressed or minimized to prevent a yellowing phenomenon leading to a lowering in display quality.

Another object of the present invention is to provide a liquid crystal apparatus including a liquid crystal device in which a difference in liquid crystal movement characteristic due to a difference in molecular position (S1 or S2 state) is minimized.

A further object of the present invention is to provide a driving method for the liquid crystal device described above.

According to the present invention, there is provided a liquid crystal apparatus, comprising:

a liquid crystal device including a pair of first and second substrates and a liquid crystal disposed between the first and second substrates, said liquid crystal being capable of having at least two stable states S1 and S2 and capable of causing a cumulative translational movement depending on a change in an external electric field applied to said liquid crystal, and means for applying an asymmetrical drive signal waveform having an effective frequency range to the liquid crystal so as to provide an absolute value of a difference between an inversion frequency $f_{01}$ where a direction of the movement of the liquid crystal is turned in an opposite direction in the state S1 and an inversion frequency $f_{02}$ where a direction of the movement of the liquid crystal is turned in an opposite direction in the state S2 smaller than a difference therebetween in the case of applying a symmetrical drive signal waveform to the liquid crystal, the inversion frequencies $f_{01}$ and $f_{02}$ being in the effective frequency range of the asymmetrical drive signal waveform.

According to the present invention, there is also provided a driving method for a liquid crystal device comprising a pair of substrates and a liquid crystal disposed between the substrates, the liquid crystal being capable of having at least two stable states S1 and S2 and capable of causing a cumulative translational movement depending on a change in an external electric field applied to the liquid crystal; the method comprising:

applying an asymmetrical drive signal waveform having an effective frequency range to the liquid crystal so as to provide an absolute value of a difference between an inversion frequency $f_{01}$ where a direction of the movement of the liquid crystal is turned in an opposite direction in the state S1 and an inversion frequency $f_{02}$ where a direction of the movement of the liquid crystal is turned in an opposite direction in the state S2 smaller than a difference therebetween in the case of applying a symmetrical drive signal waveform to the liquid crystal, the inversion frequencies $f_{01}$ and $f_{02}$ being in the effective frequency range of the asymmetrical drive signal waveform.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
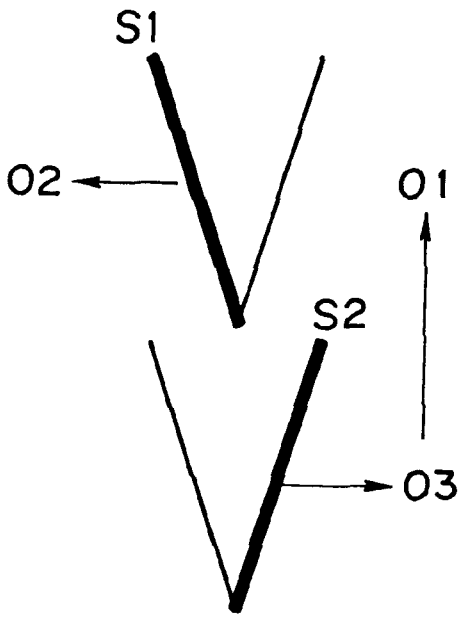
FIG. 1 is a schematic view showing an embodiment of a relationship between bistable states (S1 and S2) and associated directions of movement with respect to chiral smectic (ferroelectric) liquid crystal molecules.

The present invention is principally characterized by using an asymmetrical cell structure and asymmetrical drive (applied) signal waveform for S1 and S2 states in combination. In the present invention, an asymmetry of the liquid crystal movement (i.e., a difference in direction and/or degree of the movement) resulting from an asymmetry of a cell structure is alleviated by or counterbalanced with that resulting from an asymmetry of drive waveforms for S1 and S2 states or the latter is alleviated by or counterbalanced with the former.

More specifically, a difference between a reverse frequency $f_{01}$ in S1 state (of a chiral smectic liquid crystal) and a reverse frequency $f_{02}$ in S2 state, i.e., $(f_{01}-f_{02})$ may preferably be closer to zero as described above. The difference $(f_{01}-f_{02})$ is principally affected by a difference $(f_{01}-f_{02})_S$ resulting from an asymmetry of a cell structure and a difference $(f_{01}-f_{02})_W$ resulting from an asymmetry of an (asymmetrical) applied drive signal waveform. In the present invention, the differences $(f_{01}-f_{02})_S$ and $(f_{01}-f_{02})_W$ may preferably satisfy the following relationship:

$$(f_{01}-f_{02})_S\times(f_{01}-f_{02})_W<0.$$

In other words, the above differences may preferably have mutually different signs (+ and −, or − and +). In a particularly preferred embodiment of the present invention, the above differences may desirably have absolute values closer to each other, thus leading to a difference $(f_{01}-f_{02})$, in the liquid crystal apparatus or driving method according to the present invention, closer to zero.

Herein, with respect to the cell structure, the "asymmetry (asymmetrical cell structure)" means a cell structure other than a symmetrical cell structure. Specifically, the asymmetrical cell structure may generally include such a cell structure that a pair of first and second laminations (each including substrate, electrode, alignment control film, etc.) contacting a liquid crystal layer are formed by mutually different processes so as to have structural factors different from each other in terms of, e.g., a surface shape at the boundary with the liquid crystal layer, a material for an alignment control layer, conditions for uniaxial aligning (or rubbing) treatment at the boundary with the liquid crystal layer (such as roller feed rate, roller rotation speed or pressing depth) including no treatment with respect to one of the first and second laminations, or a shape of a plurality of electrodes (including transparent electrodes and/or an auxiliary electrodes). On the other hand, the symmetrical cell structure covers not only a cell structure including first and second laminations identical to each other in structural factors as described above but also a cell structure having an electrode matrix wherein striped transparent electrodes of the first lamination and striped transparent electrodes of the second lamination intersect with each other at right angles while forming an angle of 45 degrees with respect to the corresponding rubbing axes, respectively.

Further, with respect to the applied drive signal waveform, the "asymmetry (asymmetrical waveform)" means a difference between a first waveform for writing (providing) S1 state and a second waveform for writing S2 state in, e.g., the number of a reset pulse, a pulse width for writing and/or resetting each state (writing pulse width and/or reset (pulse width) or an amplitude of an electric field for writing each state. The reset pulse referred to herein means a pulse for once inverting (resetting) liquid crystal molecules in one stable state (e.g., S1 state or S2 state) before writing some predetermined state (e.g., S1 state).

Figure 5A:
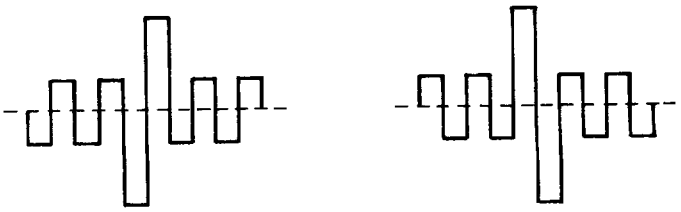
FIGS. 5A–5E are respectively drive waveforms for providing S1 and S2 states applied to a liquid crystal layer in Experiments 1–3 appearing hereinafter.

In the present invention, the "symmetry" and "asymmetry" with respect to the drive signal waveform applied to the liquid crystal layer may be determined by a relationship between two component waveforms for providing S1 and S2 states. Specifically, for example, if the component waveforms provide a symmetrical relationship therebetween with respect to the abscissa (reference line of V=0), the resultant drive signal waveform is referred to as a symmetrical waveform (e.g., Waveform A shown in FIG. 5A).

In a preferred embodiment of the present invention, one of the above-mentioned laminations may be roughened at its inner boundary between an alignment control film and a liquid crystal.

In the present invention, a liquid crystal device (cell) used may preferably provide a pretilt angle of at least 10 degrees or at most 5 degrees in its effective optical modulation region. Further, it is also preferred that a liquid crystal is disposed between the laminations together with a plurality of adhesive beads and/or spacer beads.

According to our study, we have confirmed that the liquid crystal movement is generally affected by various factors, such as a frequency, a voltage and a bias ratio of a drive signal waveform but the direction of liquid crystal movement is largely affected by the frequency of the drive signal waveform used. We have also found that the inversion (zero-crossing) frequency is liable to be changed by a cell thickness, a surface shape (e.g., uneven shape) of substrates (or alignment control films), a pretilt angle, a material for an alignment control film, a liquid crystal material, temperature, etc.

Of these factors, in the case where a cell structure is designed so that a surface shape, a pretilt angle and an alignment control film material are changed with respect to a pair of first and second substrates, an inversion frequency $f_{01}$ of liquid crystal molecules placed in S1 state and an inversion frequency $f_{02}$ of those in S2 state are different from each other even when a liquid crystal device is driven by means of a symmetrical drive signal waveform. On the other hand, with respect to a combined (composite) signal of a scanning signal and a data signal, in the case where a combined signal for writing S1 state and that for writing S2 state do not provide a symmetrical relationship, an inversion frequency $f_{01}$ (for S1 state) is different from an inversion frequency $f_{02}$ (for S2 state) even when a symmetrical cell structure is employed.

Accordingly, as described above, when the product of difference $(f_{01}-f_{02})_S$ resulting from an asymmetry of a cell structure by a difference $(f_{01}-f_{02})_W$ resulting from an asymmetry of an applied drive signal waveform (driving condition) becomes a negative value, a resultant asymmetry of the liquid crystal movement is alleviated by the above combination of the asymmetrical cell structure and the asymmetrical driving condition.

On the other hand, in the case where a cell structure is entirely symmetrical to provide a difference $(f_{01}-f_{02})_S$ resulting a symmetry therefrom of zero, an applied drive signal waveform may preferably be symmetrical. Further, in the case where a symmetrical drive signal waveform is applied to a liquid crystal layer to provide a difference $(f_{01}-f_{02})_W$ resulting therefrom of zero, a symmetrical cell structure may preferably be adopted. In these cases, the product of $(f_{01}-f_{02})_S$ by $(f_{01}$31 $f_{02})_W$ becomes zero.

Based on the above-described relationships between the cell structures and the driving conditions, it becomes possible to realize a high-reliability liquid crystal apparatus using a (chiral smectic) liquid crystal device in which the liquid crystal movement is effectively minimized or suppressed to less increase a cell thickness and display irregularity (e.g., yellowing), irrespective of liquid crystal molecular position (S1 or S2 state).

Hereinbelow, a preferred embodiment of a liquid crystal device used in the present invention will be described more specifically with reference to FIG. 2.

Figure 2:
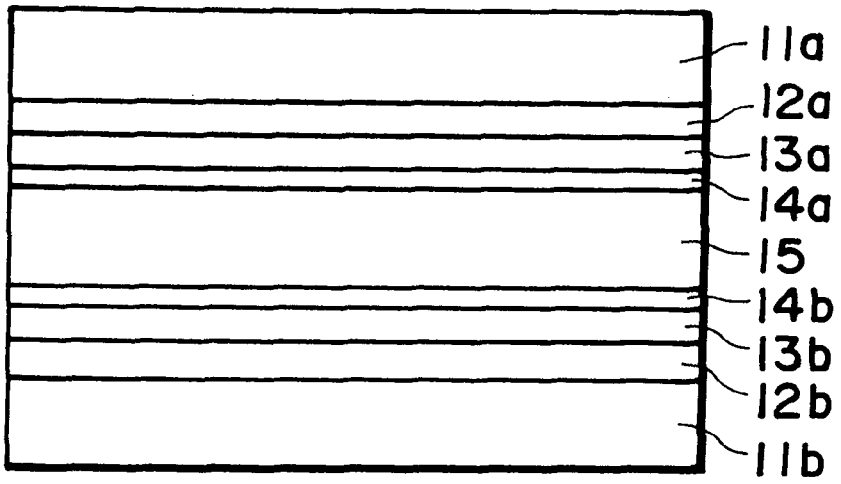
FIG. 2 is a schematic sectional view of an embodiment of a liquid crystal device used in the present invention.

FIG. 2 shows a schematic sectional view of an embodiment of a chiral smectic liquid crystal device.

Referring to FIG. 2, a pair of substrates 11*a* and 11*b* are coated with ca. 40–300 nm-thick transparent electrodes 12*a* and 12*b*, e.g., comprising oxides, such as tin oxide, indium oxide and indium-tin oxide (ITO). On the transparent electrodes 12*a* and 12*b*, ca. 10–300 nm-thick insulating films 13*a* and 13*b* for preventing a short circuit between the substrates are formed. The insulating films 13*a* and 13*b* comprise oxides, such as ZnO, ZrO and TaOx. Further, either one or both of the insulating films 13*a* and 13*b* may be omitted, as desired. Each of the insulating films 13*a* and 13*b* may be formed in a single layer, e.g., formed by wet coating and hot baking or in plural layers including, e.g., a layer formed by sputtering. On the insulating films 13*a* and 13*b* (or the transparent electrodes 12*a* and 12*b*), alignment control films 14*a* and 14*b* are formed in a thickness of ca. 5–100 nm. Either one or both of the alignment control films 14*a* and 14*b* may preferably comprise a film of an organic polymer, such as nylon or polyimide, which has been subjected to a uniaxial aligning treatment, such as rubbing. One of the alignment control films 14*a* and 14*b* may be a film of, e.g., polysiloxane, which has not been subjected to a uniaxial aligning treatment. In order to provide the alignment control films with a stable uneven surface, fine particles may be incorporated into the insulating films and/or the alignment control films. Between the thus treated substrates 11*a* and 11*b*, a layer of a chiral smectic liquid crystal 15, preferably a ferroelectric liquid crystal assuming bistability or an antiferroelectric liquid crystal assuming three stable states is disposed to form a liquid crystal cell (device). Outside the liquid crystal cell, a pair of polarizers (not shown) may generally be disposed.

The chiral smectic liquid crystal 15 may preferably be formulated as a chiral smectic liquid crystal composition comprising at least one species of a phenylpyrimidine-based liquid crystal material and a chiral dopant. The chiral smectic liquid crystal 15 may preferably assume a chiral smectic state, such as chiral smectic C (SmC*) phase, chiral smectic H (SmH*) phase, chiral smectic I (SmI*) phase, chiral smectic K (SmK*) phase or chiral smectic G (SmG*) phase, preferably SmC* phase, in its operational state.

In a particularly preferred embodiment of the present invention, the chiral smectic liquid crystal 15 has cholesteric (Ch) phase and smectic A (SmA) phase at a higher temperature side of SmC* phase. In such a liquid crystal, when the liquid crystal is gradually cooled from isotropic phase (Iso.), a direction of liquid crystal molecules (long axis direction) is uniformly directed in one direction in Ch phase, and in SmA phase, a layer structure extending in a direction perpendicular to the liquid crystal molecule direction is formed, and then in SmC* phase, the liquid crystal molecule direction is tilted or inclined with respect to the original direction thereof, thus resulting in a uniform alignment state because of successive formation of plural orders as to liquid crystal molecules. For this reason, a pyrimidine-based liquid crystal mixture A (used in Experimental Examples 1–3 appearing hereinafter) having the following phase transition series and physical properties may suitably be used.

Phase Transition Temperature (° C.)

$$\text{Cryst.} \xrightarrow{-3} \text{SmC*} \xrightarrow{57} \text{SmA} \xrightarrow{79} \text{Ch.} \xrightarrow{85} \text{Iso.}$$

Tilt angle (at 30° C.)=14 degrees

Layer inclination angle (at 30° C.)=11 degrees

Apparent tilt angle (at 30° C.)=11 degrees

In the present invention, the chiral smectic liquid crystal 15 may have another phase transition series, e.g., lacking Ch phase. Examples of a liquid crystal material lacking Ch phase may include a liquid crystal composition containing at least one species of a fluorine-containing liquid crystal compound as disclosed in U.S. Pat. No. 5,082,587, WO-A 93/22396, etc.

The liquid crystal device described above is used as a display element (medium) of the liquid crystal apparatus of the present invention, one embodiment of which is described below.

Figure 6:
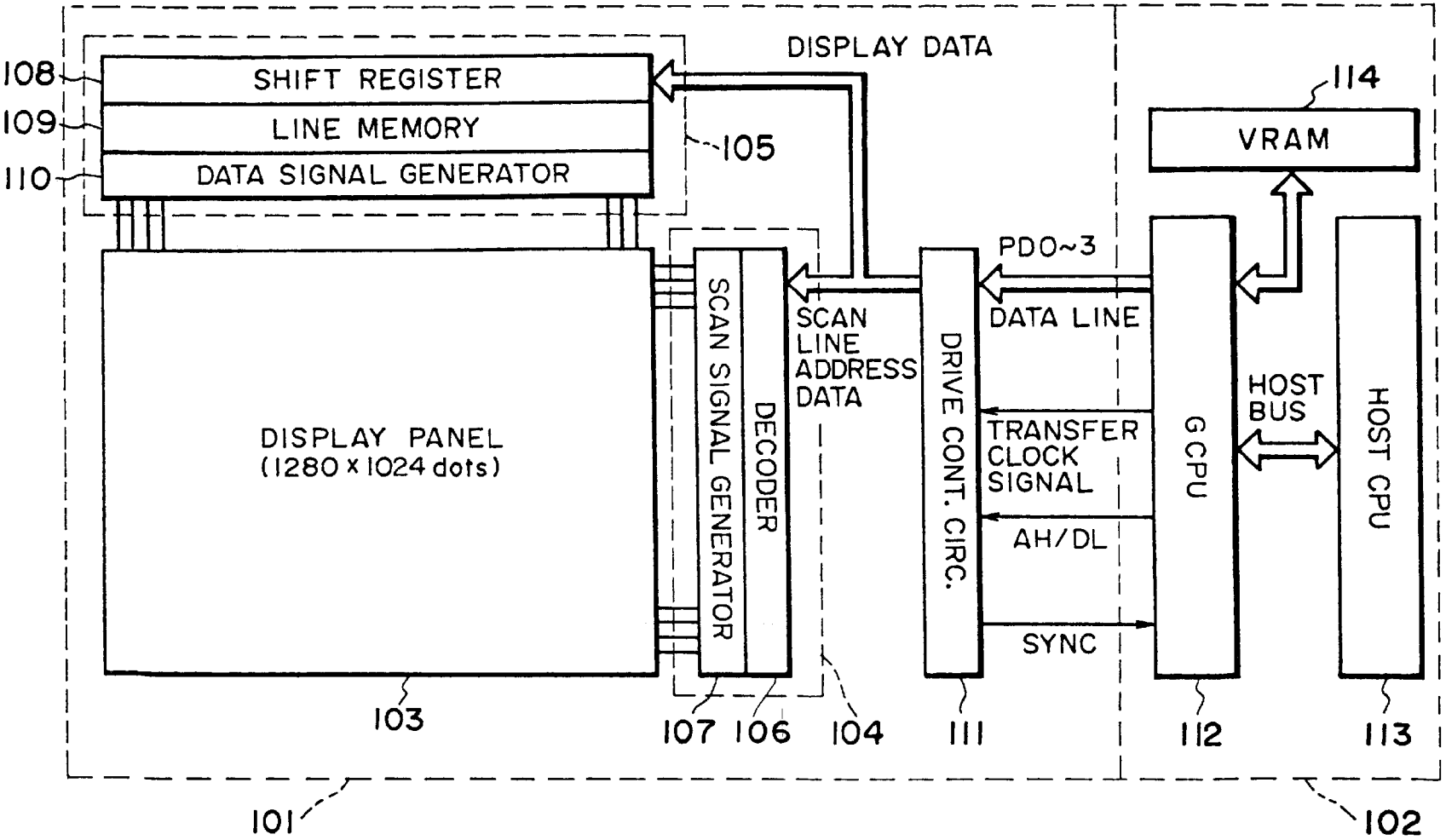
FIG. 6 is a block diagram showing a liquid crystal display apparatus comprising a liquid crystal device of the present invention and a graphic controller.
Figure 7:
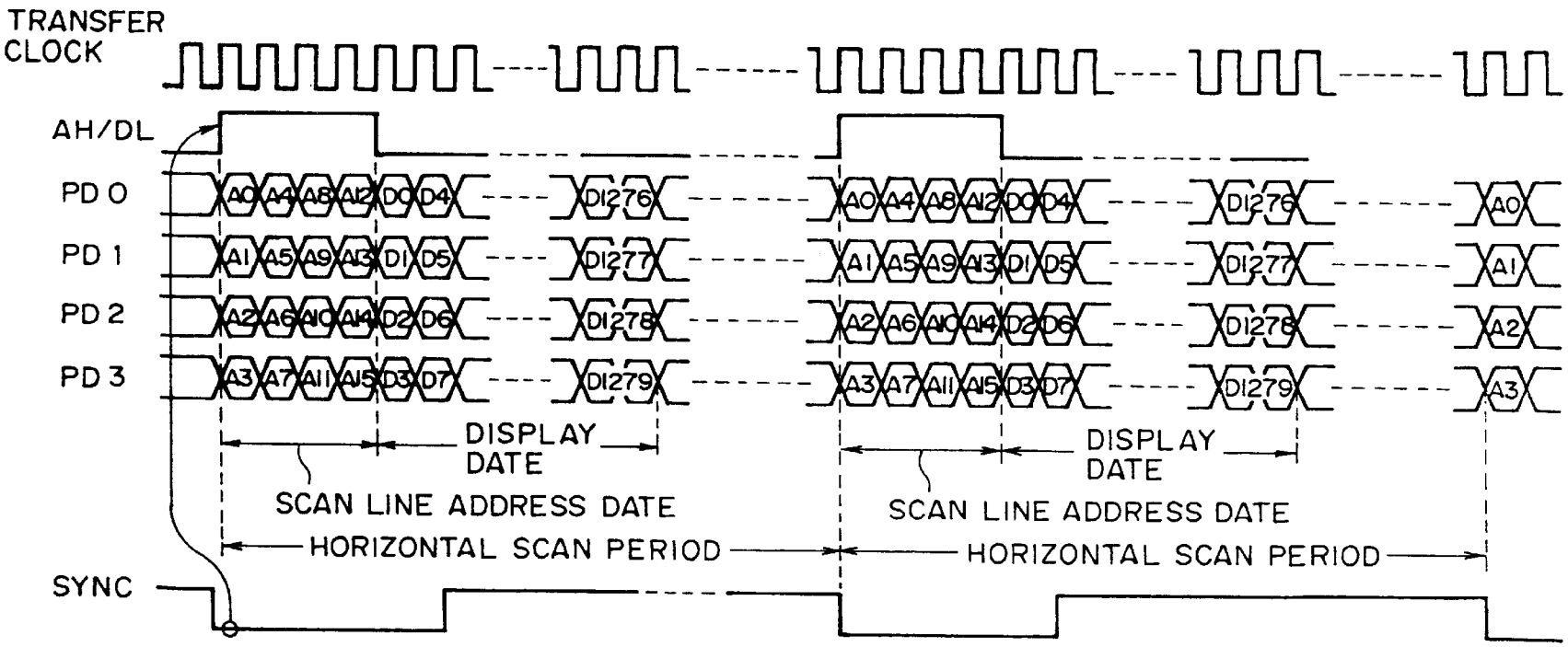
FIG. 7 is a time chart of image data communication showing time correlation between signal transfer and driving with respect to a liquid crystal display apparatus and a graphic controller.

Based on an arrangement appearing hereinbelow and data format comprising image data accompanied with scanning line address data and by adopting communication synchronization using a SYNC signal as shown in FIGS. 6 and 7, there is provided a liquid crystal display apparatus of the present invention which uses the liquid crystal device as a display panel portion.

Referring to FIG. 6, a chiral smectic liquid crystal display apparatus 101 includes a graphic controller 102, a display panel 103, a scanning line drive circuit 104, a data line drive circuit 105, a decoder 106, a scanning signal generator 107, a shift resistor 108, a line memory 109, a data signal generator 110, a drive control circuit 111, a graphic central processing unit (GCPU) 112, a host central processing unit (host CPU) 113, and an image data storage memory (video-RAM, VRAM) 114.

Image data are generated in the graphic controller 102 in an apparatus body and transferred to a display panel 103 by signal transfer means. The graphic controller 102 principally comprises a CPU (central processing unit, referred to as "GCPU") 112 and a VRAM (image data storage memory) 114 and is in charge of management and communication of image data between a host CPU 113 and the liquid crystal display apparatus 101. A light source (not shown) is disposed behind the display panel 103.

The liquid crystal (display) apparatus of the present invention employs the above-described liquid crystal device showing a good switching characteristic as a display panel (medium), so that the apparatus exhibits excellent drive characteristics and reliability and provides high-definition and large-area display images at high speed.

The liquid crystal device used in the present invention may be driven by using driving methods as disclosed in, e.g., JP-A 59-193426, JP-A 59-193427, JP-A 60-156046 and JP-A 60-156047.

Figure 9:
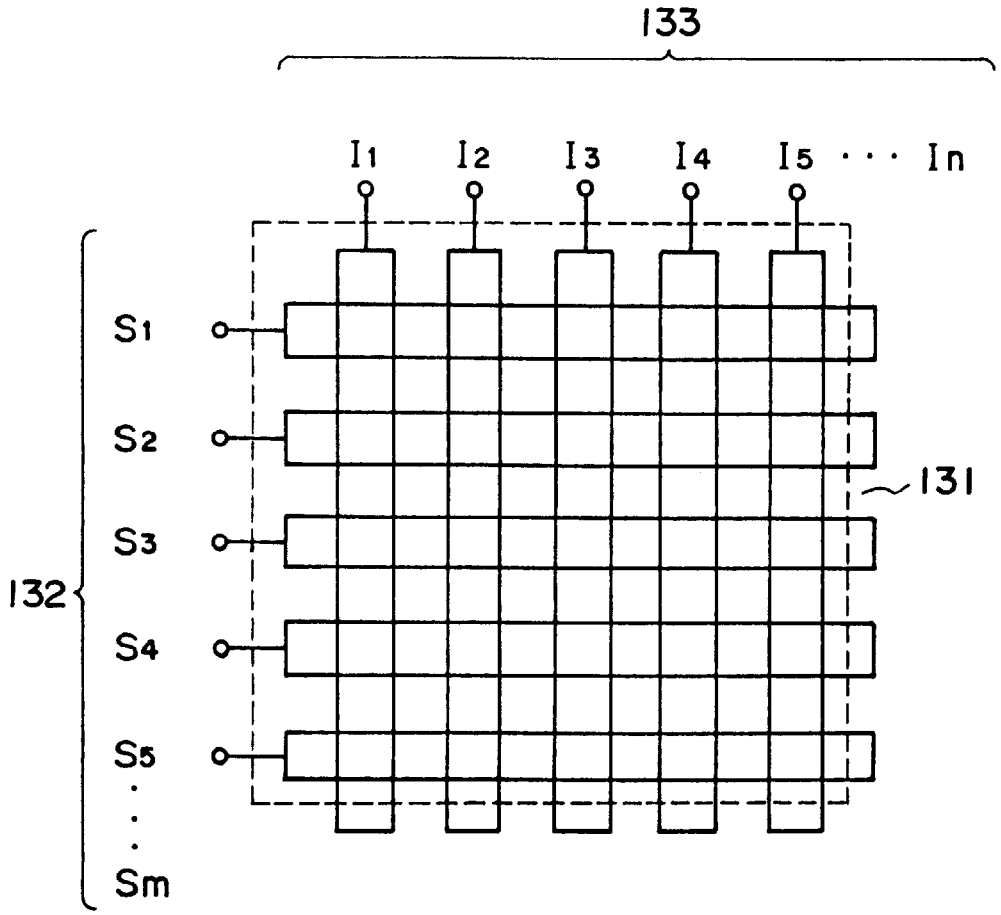
FIG. 9 is a plan view of an electrode matrix.
Figure 10A:
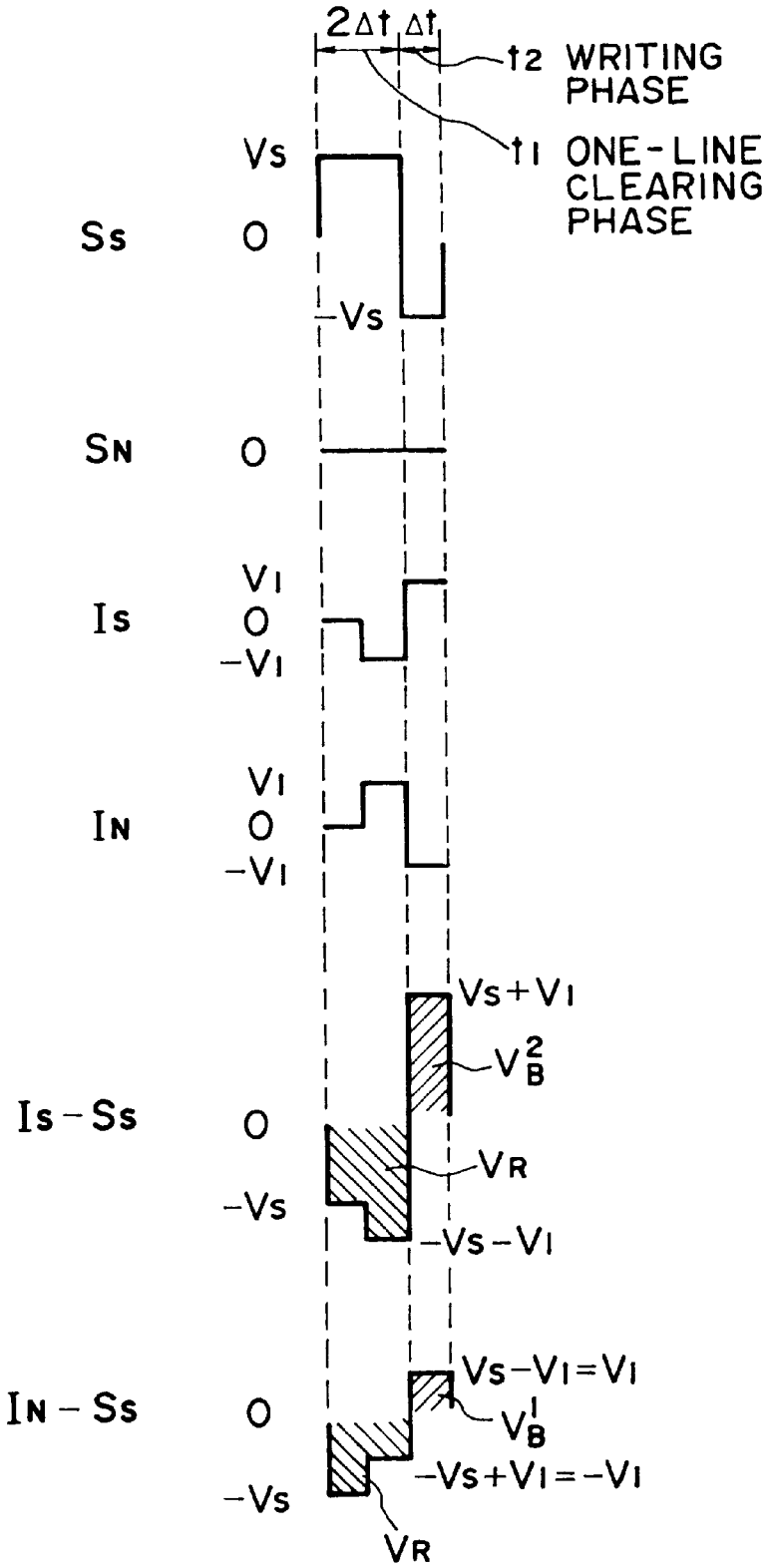
FIG. 10A shows an embodiment of unit driving waveforms.
Figure 10B:
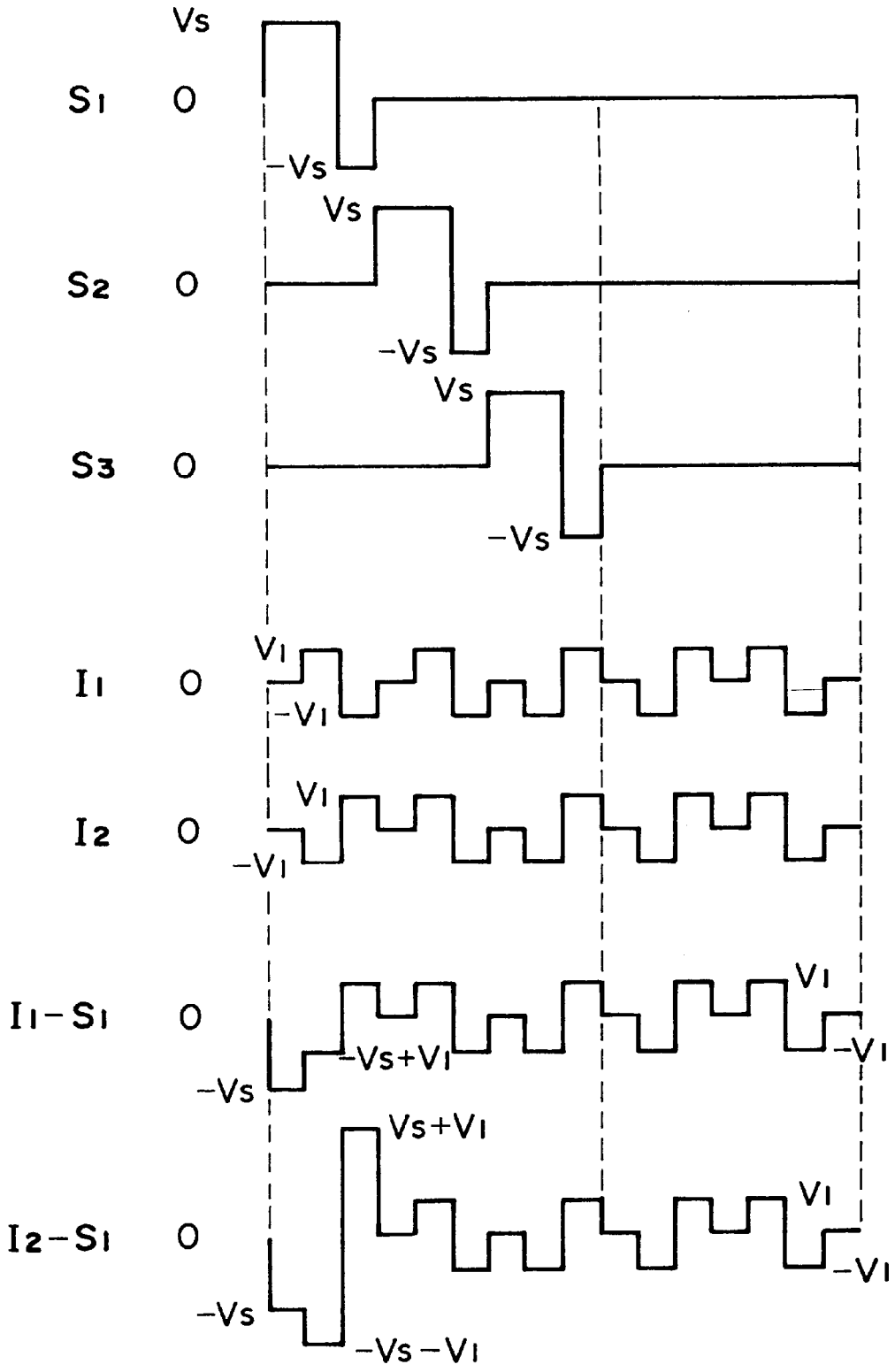
FIG. 10B is time-serial waveforms comprising a succession of such unit waveforms.

FIGS. 10A and 10B are waveform diagrams showing an example set of driving waveforms used in such a driving method. FIG. 9 is a plan view showing an electrode matrix used in a liquid crystal panel 131 of a simple matrix-type. The liquid crystal panel 131 shown in FIG. 9 includes scanning electrodes 132 ($S_1$, $S_2$, $S_3$, . . . $S_m$) and data electrodes 133 ($I_1$, $I_2$, $I_3$, . . . $I_n$) intersecting each other so as to constitute a pixel at each intersection together with the liquid crystal material disposed between the scanning electrodes 132 and data electrodes 133.

Figure 8:
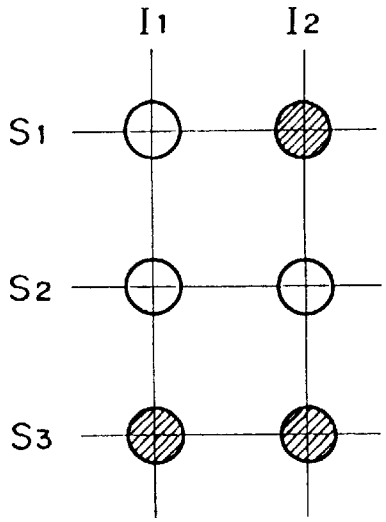
FIG. 8 is an illustration of a display pattern.

Referring to FIG. 10A, at $S_S$ is shown a selection scanning signal waveform applied to a selected scanning line in one-line scanning period (1H period), at $S_N$ is shown a non-selection scanning signal waveform applied to a non-selected scanning line in 1H period, at $I_S$ is shown a selection data signal waveform (providing a black (dark) display state) applied to a selected data line in 1H period, and at $I_N$ is shown a non-selection data signal waveform (providing a white (bright) display state) applied to a non-selected data line in 1H period. Further, at $I_S$–$S_S$ and $I_N$–$S_S$ in the figure are shown voltage waveforms applied to pixels on a selected scanning line, whereby a pixel supplied with the voltage $I_S$–$S_S$ assumes a black display state and a pixel supplied with the voltage $I_N$–$S_S$ assumes a white display state. FIG. 10B shows a time-serial waveform used for providing a display state as shown in FIG. 8.

In the driving embodiment shown in FIGS. 10A and 10B, a minimum duration (application time) Δt of a single polarity voltage applied to a pixel on a selected scanning line corresponds to the period of a writing phase $t_2$, and the period of a one-line clearing phase $t_1$ is set to 2Δt. In the one-line clearing phase $t_1$, the display (writing) state is reset to provide a white display state in this embodiment.

The parameters $V_S$, $V_I$ and Δt in the driving waveforms shown in FIGS. 10A and 10B are determined depending on switching characteristics of a liquid crystal material used.

Figure 11:
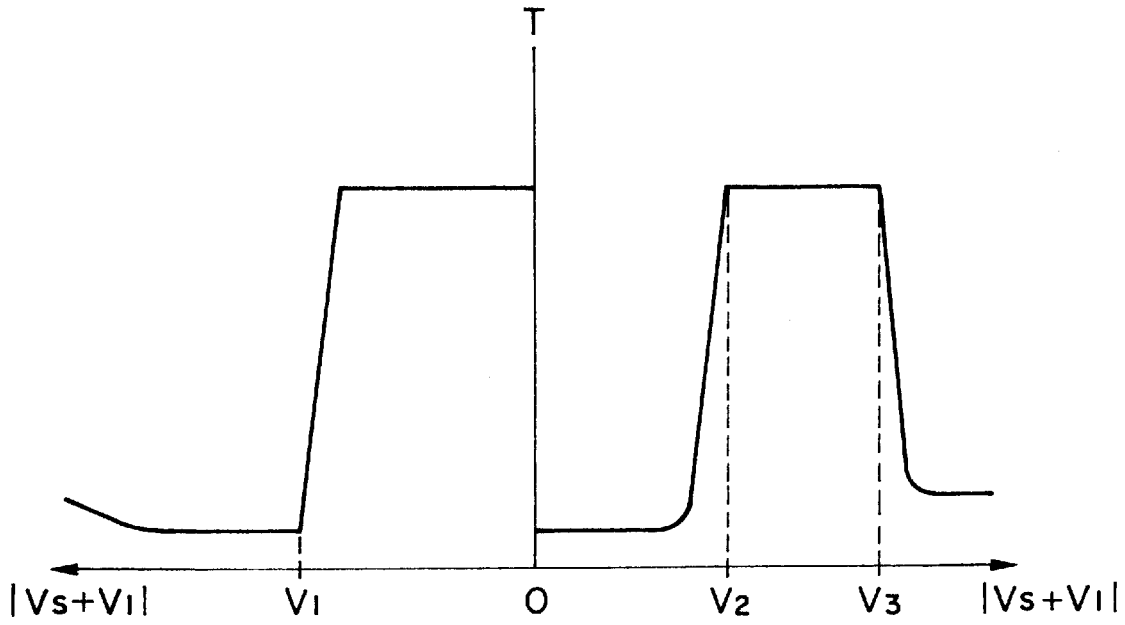
FIG. 11 is a V-T characteristic chart showing a change in transmittance under application of different drive voltages.

FIG. 11 shows a V-T characteristic, i.e., a change in transmittance T (ordinate) when a driving voltage (abscissa) denoted by $(V_S+V_I)$ (absolute value) is changed (to provide a larger value proportional to a distance from the origin) while a bias ratio (as mentioned hereinbelow) is kept constant. In this embodiment, the parameters are fixed at constant values of Δt=50 μs and a bias ratio $V_I/(V_I+V_S)=1/3$. On the right side of FIG. 11 is shown a result when the voltage $(I_N–S_S)$ shown in FIG. 10A is applied to a pixel concerned previously set in a black state (previous state). On the left side of FIG. 11 is shown a result when the voltage $(I_S–S_S)$ is applied to a pixel concerned previously set in a white state. At $(I_N–S_S)$ and $(I_S–S_S)$, a previous (display) state is cleared in a white state by applying a voltage $V_R$ and a subsequent (display) state is determined by voltages $V_B^1$ and $V_B^2$, respectively. Referring to FIG. 11, a relationship of $V_2<V_1<V_3$ holds. The voltage $V_1$ may be referred to as a threshold voltage in actual drive and the voltage $V_3$ may be referred to as a crosstalk voltage. More specifically, as shown in FIG. 10A, a voltage $V_1$ denotes a voltage value causing switching (white to black) by applying a voltage signal $V_B^2$ and a voltage $V_3$ denotes a voltage value unexpectedly causing switching (white to black) by applying a voltage signal $V_B^1$. Further, a voltage $V_2$ denotes a voltage value required for clearing the previous state into a white state by applying a voltage signal $V_R$. The crosstalk voltage $V_3$ generally exists in actual matrix drive of a (ferroelectric) chiral smectic liquid crystal device. In an actual drive, $\Delta V=V_3-V_1$ provides a voltage range of $|V_S+V_I|$ allowing a matrix drive and may be referred to as a (drive) voltage margin. It is of course possible to provide an increased value of $V_3$ leading to a larger voltage margin $\Delta V(=V_3-V_1)$ by increasing the bias ratio (i.e., by causing the bias ratio to approach a unity). However, a large bias ratio corresponds to a large amplitude of a data signal and leads to an increase in flickering and a lowering in contrast, thus being undesirable in respect of image quality. According to our study, a bias ratio of about 1/3–1/4 was practical. On the other hand, when the bias ratio is fixed, the voltage margin ΔV largely depends on the switching characteristics of a liquid crystal material used and a device structure adopted, and it is needless to say that a liquid crystal device providing a large ΔV is very advantageous for matrix drive.

Further, it is also possible to drive the liquid crystal device by changing a minimum voltage application time (minimum duration) Δt while keeping the driving voltage $(V_S+V_I)$ at a certain (constant) value. In this case, it is possible to provide a graph similar to that of FIG. 11 except that the minimum voltage application time Δt is taken as the abscissa instead of the driving voltage $(V_S+V_I)$, whereby the drive characteristic of the liquid crystal device can be evaluated in terms of a duration margin (voltage application time margin) $\Delta T=\Delta t_2-\Delta t_1$ wherein $\Delta t_1$ denotes a threshold duration and $\Delta t_2$ denotes a crosstalk duration. The duration margin ΔT means a duration allowing a matrix drive under application of a certain driving voltage $(V_S+V_I)$. Similarly as in the duration margin, the drive characteristic of the liquid crystal device is also evaluated in terms of a ratio of $(\Delta t_2-\Delta t_1)/(\Delta t_2+\Delta t_1)$ in many cases. The ratio of $(\Delta t_2-\Delta t_1)/(\Delta t_2+\Delta t_1)$ is sometimes referred to as an M2 margin.

As described above, depending on the directions (signs) of two different data signals, the voltage margin ΔV and duration margin ΔT each allow such a display state that selected pixels are written in two states of "black" and "white" and non-selected pixels can retain the previous "black" or "white" state. At the certain temperature, the voltage margin and the duration margin vary depending on a liquid crystal material used and a cell structure employed and are intrinsic to a liquid crystal device used. Further, these drive margin (voltage or duration margin) are changed depending on a change in environmental temperature, so that it is necessary to optimize driving conditions for an actual display apparatus in view of a liquid crystal material used, a cell (device) structure and an environmental temperature.

The values of pretilt angle α and inversion (zero-crossing) frequencies $f_{01}$ and $f_{02}$ referred to herein are based on values measured according to the following methods.

Measurement of Pretilt Angle α

The measurement is performed according to the crystal rotation method as described at Jpn. J. Appl. Phys. vol. 19 (1980), No. 10, Short Notes 2013.

More specifically, a sample cell is formed by applying a pair of substrates to each other with a cell gap of 20 μm so that rubbing treatment axes are parallel to each other but are directed in opposite directions to each other (anti-parallel relationship), i.e., liquid crystal molecules are inclined (tilted) in parallel with each other and in an identical direction with respect to the boundaries of the pair of substrates. The cell gap is filled with a standard liquid crystal mixture for measurement assuming SmA phase in the temperature range of 10–55° C. obtained by mixing 80 wt. % of a ferroelectric liquid crystal ("CS-1014", mfd. by Chisso K.K.) with 20 wt. % of a compound represented by the following formula:

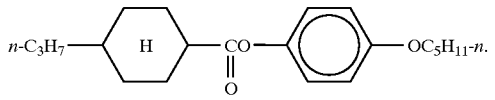

For measurement, the liquid crystal cell (sample cell) is rotated in a plane perpendicular to the pair of substrates and including the aligning treatment axis (rubbing axis) and, during the rotation, the cell is illuminated with a helium-neon laser beam having a polarization plane forming an angle of 45 degrees with respect to the rotation plane in a direction perpendicular to the rotation plane, whereby the intensity of the transmitted light is measured by a photodiode from the opposite side through a polarizer having a transmission axis parallel to the polarization plane.

A pretilt angle α is obtained through a simulation wherein a fitting of a spectrum of the intensity of the transmitted light obtained by interference is effected with respect to the following theoretical curve (a) and relationship (b):

$$T(\phi) = \cos^2\left[\frac{\pi d}{\lambda}\left(\frac{NeNo\sqrt{N^2(\alpha) - \sin^2\phi}}{N^2(\alpha)} - \sqrt{No^2 - \sin^2\phi} - \frac{Ne^2 - No^2}{N^2(\alpha)}\sin\alpha \cdot \cos\alpha \cdot \sin\phi\right)\right], \quad \text{(a)}$$

and $$N(\alpha) \equiv No^2 \cdot \cos^2\alpha + Ne^2 \cdot \sin^2\alpha, \quad \text{(b)}$$

wherein No denotes the refractive index of ordinary ray, Ne denotes the refractive index of extraordinary ray, ø denotes the rotation angle of the cell, T(ø) denotes the intensity of the transmitted light, d denotes the cell thickness, and λ denotes the wavelength of the incident light.

Measurement of Inversion Frequency

Figure 4A:
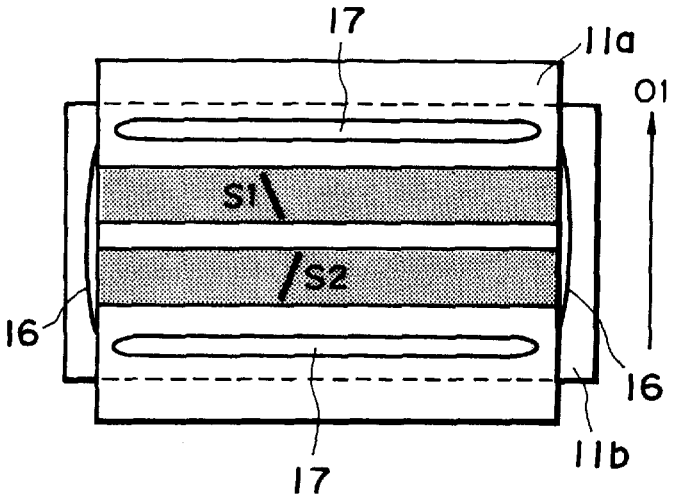
FIG. 4A is a schematic plan view showing an embodiment of a liquid crystal cell for measuring a moving rate of liquid crystal molecules and FIG. 4B is a schematic plan view for illustrating a liquid crystal movement phenomenon.

FIG. 4A shows a liquid crystal cell including a pair of substrates 11*a* and 11*b* for measuring a moving rate of liquid crystal molecules, wherein opening portions and electrode terminal portions are formed. A plurality of elongated liquid crystal molecular layers are arranged perpendicular to a layer normal direction 01 predetermined by a uniaxial aligning axis.

In the above cell, a sealing agent 17 is disposed on parallel two sides perpendicular to the layer normal 01 so as to leave two openings opposite to each other. Into the cell, a chiral smectic liquid crystal is filled and, at each opening of both end portions of the cell, an about 1 mg of a nematic liquid crystal 16 ("ZLI-1132", manufactured by Merck Co.) is applied to prepare a sample liquid crystal cell as shown in FIG. 4A.

Figure 4B:
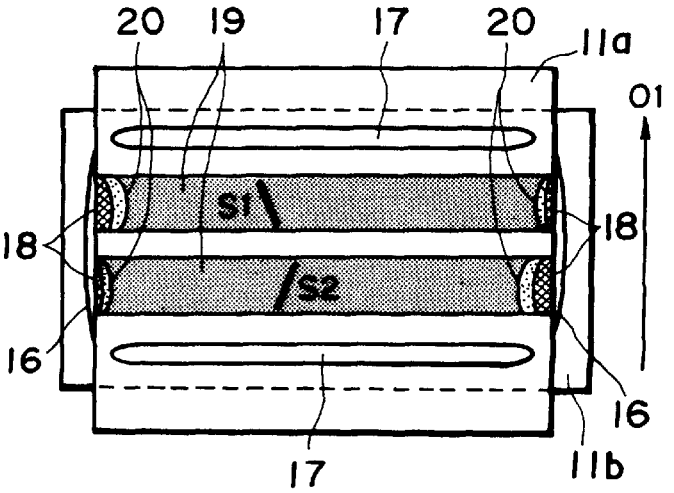

Then, the sample liquid crystal cell is driven under desired drive conditions, such as temperature, drive waveform, drive voltage and drive frequency. During the drive of the liquid crystal cell, a liquid crystal movement phenomenon of the chiral smectic liquid crystal is observed in a direction perpendicular to the layer normal direction 01. More specifically, as shown in FIG. 4B, the nematic liquid crystal 16 disposed at the end portions is caused to enter the inside of the cell (toward the center thereof) to provide an SmA phase portion 20 and a nematic (N) phase portion 18. After a lapse of a prescribed time (10 Hr), distances $a_{S1}$, $b_{S1}$, $a_{S2}$ and $b_{S2}$ (mm) (not shown) each from the corresponding opening edge to the corresponding boundary between the SmC* phase portion 19 and the SmA phase portion 20 (or between the SmA phase portion 20 and the N phase portion 18) as shown in FIG. 4B are measured to determine a moving rate X1 (mm/10 Hr) of the liquid crystal in S1 state from a difference between $a_{S1}$ and $b_{S1}$ and a moving rate X2 (mm/10 Hr) of the liquid crystal in S2 state from a difference between $a_{S2}$ and $b_{S2}$, respectively.

In order to preclude the influence of natural diffusion of the nematic liquid crystal, a difference between the associated two distances ($a_{S1}$ and $b_{S1}$ or $a_{S2}$ and $b_{S2}$) is adopted in the present invention.

According to the above method, a moving rate (X1, X2) of the above-mentioned pyrimidine-based liquid crystal mixture A is measured while appropriately changing drive frequencies (10 kHz, 15 kHz, 20 kHz and 25 kHz) at 30° C. The inversion frequencies $f_{01}$ and $f_{02}$ are determined as a frequency where the moving rate of the liquid crystal mixture becomes 0 from a graph representing a relationship between the moving rates X1 and X2 and the drive frequencies, respectively.

In place of the above-described sample cell for measurement, a part of a liquid crystal cell including a liquid crystal may also be used by cutting the part and providing the part with openings and electrode terminals similarly as in the sample cell described above.

Hereinbelow, the present invention will be described specifically based on Experimental Examples.

EXPERIMENTAL EXAMPLE 1

In this experimental example, a symmetrical cell (structure) was employed.

Two 1.1 mm-thick glass substrates (300 mm×320 mm) were coated with ca. 150 nm-thick ITO films by sputtering, which were then patterned into stripe electrodes (transparent electrodes) of ca. 250 μm in width through a photolithographic process. Each of the stripe electrodes were then coated with a 6.0 wt. % solution of an insulating material (containing Ti:Si=1:1) containing silica fine particles of ca. 50 nm in average diameter dispersed therein by using an extended plate of 5 μm in roughness, followed by prebaking at 100° C. for a. 10 min., UV irradiation and baking for ca. 1 hour at 300° C., to form a ca. 20 nm-thick insulating film.

Then, each of alignment control films was formed on the associated insulating film by applying a 1.5 wt. %-solution of polyimide precursor ("LQ 1802", available from Hitachi Kasei K.K.) in an NMP (N-methylpyrrolidone)/nBC (n-butyl cellosolve) (=1/1) mixture solvent by spin coating under a spinner speed of 2000 rpm for 20 sec., followed by baking at 270° C. for 1 hour to obtain a ca. 20 nm-thick alignment control film.

Then, each substrate was rubbed two times in one direction with a nylon fiber-planted cloth under the conditions of a pressing depth ϵ of 0.35 mm, a roller rotation speed of 1000 rpm and a roller feed rate of 30 mm/sec.

On one of the substrates, silica beads having an average diameter of ca. 1.5 μm were dispersed.

The other substrate was superposed on the above substrate and applied to each other so that their rubbing directions (rubbing treatment axes) were parallel to each other and in an identical direction and that the stripe electrodes on the substrates were arranged in parallel with each other to prepare a blank cell.

Into the thus prepared blank cell, a pyrimidine-based liquid crystal mixture A described above was injected at an isotropic liquid state under reduced pressure (or in vacuum condition) and was gradually cooled to room temperature at a rate of 0.5° C./min., thus providing a liquid crystal cell (device) wherein liquid crystal molecules were uniaxially aligned in a chiral smectic C (SmC*) phase.

Separately, a liquid crystal cell for measurement of pretilt angle was prepared in the same manner as above except that a cell gap was set to 20 μm and rubbing directions (of the pair of substrates) were set to be parallel to each other and in opposite directions and that the pyrimidine-based liquid crystal mixture A was changed to the standard liquid crystal mixture described above. The thus prepared liquid crystal cell provided a pretilt angle of ca. 19 degrees as measured according to the above-described method (crystal rotation method).

Figure 3:
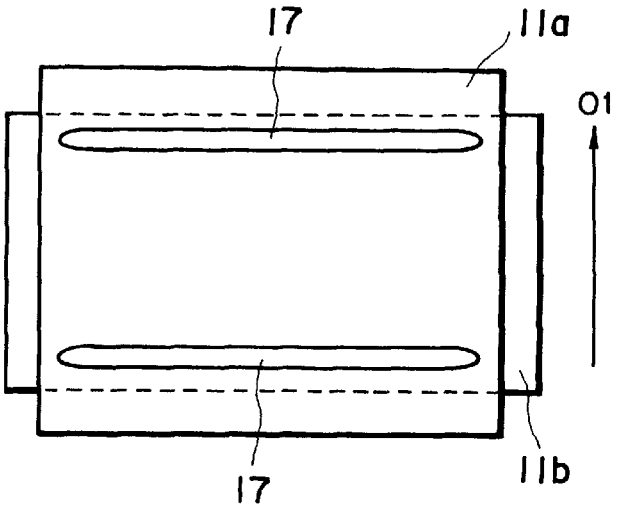
FIG. 3 is a schematic plan view showing an embodiment of a liquid crystal cell used in measurement of a moving rate of liquid crystal molecules.

The above-prepared liquid crystal cell (device) (not for measurement of pretilt angle) had a cell structure shown in FIG. 3 including a pair of substrates 11*a* and 11*b* held by oppositely disposed sealing regions 17 perpendicular to a rubbing direction 01. The liquid crystal cell was then subjected to measurement of inversion frequencies ($f_{01}$ for S1 state and $f_{02}$ for S2 state) in the above-described manner.

More specifically, for measurement of $f_{01}$ and $f_{02}$, five drive signal waveforms including a symmetrical waveform A and asymmetrical waveforms B–E shown in FIGS. 5A–5E and Table 1 below were applied to the liquid crystal cell at a duty ratio of 1/100 while changing a drive frequency (10 kHz, 15 kHz, 20 kHz and 25 kHz).

The results are shown in Table 2 below.

TABLE 1

| Waveform | A | B | C | D | E |
|---|---|---|---|---|---|
| Symmetry | Symmetrical | | Asymmetrical | | |
| State | S1/S2 | S1/S2 | S1/S2 | S1/S2 | S1/S2 |
| Reset pulse application | Yes/Yes | No/Yes | Yes/No | Yes/Yes | Yes/Yes |
| Applied*1 voltage (V) | 20/20 | 20/20 | 20/20 | 30/20 | 20/30 |
| Pulse*2 width (μsec) | 30 | 30 | 30 | 30 | 30 |

*1: An amplitude of a voltage applied to the cell in selection period.
*2: Pulse duration of the applied voltage.

*1: An amplitude of a voltage applied to the cell in selection period.
*2: Pulse duration of the applied voltage.

TABLE 2

| Waveform | A | B | C | D | E |
|---|---|---|---|---|---|
| $f_{01}$ (kHz for S1) | 15 | 13 | 15 | 14 | 15 |
| $f_{02}$ (kHz for S2) | 15 | 15 | 13 | 15 | 14 |
| $(f_{01} - f_{02})_W$ (kHz) | 0 | −2 | +2 | −1 | +1 |

As apparent from the above results, in combination with the symmetrical cell structure (in this experimental example), the symmetrical waveform (Waveform A) was found to show a difference between $f_{01}$ and $f_{02}$ ($f_{01}-f_{02}$) of zero and the asymmetrical waveforms (Waveforms B–E) failed to provide a difference ($f_{01}-f_{02}$) of zero.

Figure 5B:
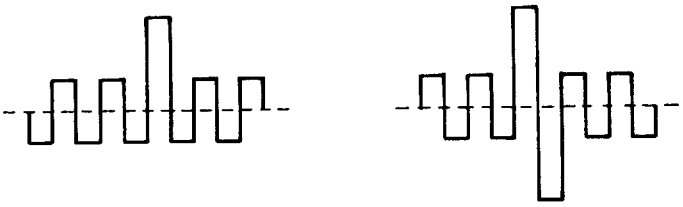
Figure 5C:
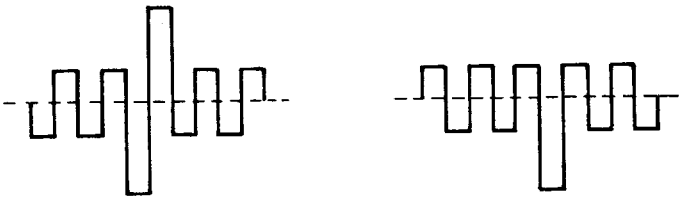
Figure 5D:
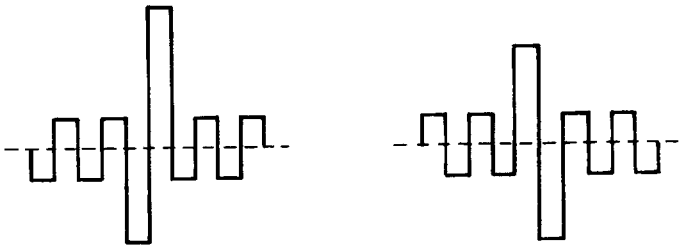

Further, as shown in FIGS. 5B and 5C, Waveform B includes a first waveform for S1 and a second waveform S2 where the first and second waveforms provide an asymmetrical relationship and Waveform C also includes first and second waveforms (for S1 and S2) providing an asymmetrical relationship. In this case, however, the first waveform of Waveform B and the second waveform of Waveform C provide a symmetrical relationship, and similarly the second waveform of Waveform B and the first waveform of Waveform C provide a symmetrical relationship.

Due to the above relationships between the component waveforms of Waveforms B and C, it was found that the difference for Waveform B (i.e., $(f_{01}-f_{02})_W=-2$ (kHz) resulting rom its asymmetry) and that for Waveform C (+2 kHz) had an identical absolute value but had different (opposite) signs.

Figure 5E:
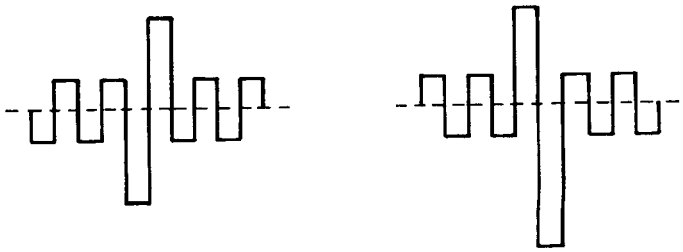

This also applies to a relationship between Waveform D (FIG. 5D) and Waveform E (FIG. 5E).

EXPERIMENTAL EXAMPLE 2

In this experimental example, asymmetrical cells were employed.

Eight liquid crystal cells (devices) were prepared in the same manner as in Experimental Example 1 except that combinations of a pair of substrates (first and second substrates) were changed, respectively, as shown in Table 3 appearing hereinafter.

The respective substrates (Substrates F–J) shown in Table 3 were prepared in the following manner.

(Substrate F)

Substrate F was prepared in the same manner as in Experimental Example 1 and was used as one of first and second substrate.

(Substrate G)

Substrate G was prepared in the same manner as in Substrate F (as also in Experimental Example 1) except for changing the roller feed rate (in rubbing treatment) of 30 mm/sec to 60 mm/sec.

(Substrate H)

Substrate H was prepared in the same manner as in Substrate F except that the average diameter (ca. 50 nm) of silica fine particles (dispersed in the insulating film) was changed to ca. 35 nm.

(Substrate I)

Substrate I was prepared in the same manner as in Substrate F except that a 25 nm-thick alignment control film was formed by applying a 2.0 wt. % -solution of a material (for forming a polyamide of the formula shown below) in an NMP/nBC (=2/1) mixture solvent by spin coating, followed by backing at 220° C. for 1 hour.

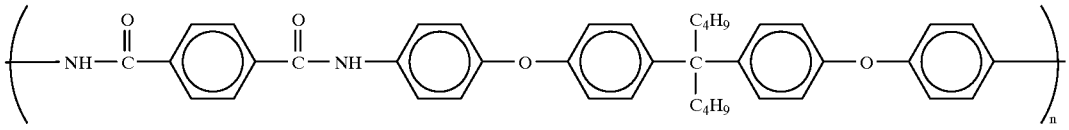

(Substrate J)

Substrate J was prepared in the same manner as in Substrate F except that 2500 Å-thick auxiliary electrodes of aluminum were formed in a stripe shape with a width of 10 μm.

The thus prepared eight liquid crystal cells were evaluated in the same manner as in Experimental Example 1 except that only the symmetrical waveform (Waveform A) was applied to the cells.

The results are shown in Table 3.

As shown in Table 3, all the liquid crystal cells failed to provide a difference in reverse frequency between two stable states S1 and S2, i.e., $(f_{01}-f_{02})_S$ resulting from an asymmetrical cell structure, of zero even when Waveform A (symmetrical waveform) was used.

Further the signs (+and −) of $(f_{01}-f_{02})_S$ were found to be changed to the opposite signs (− and +), respectively, by replacing the first and second substrates with each other while keeping identical absolute values, respectively.

EXPERIMENTAL EXAMPLE 3

Based on the results of Experimental Examples 1 and 2, an experiment was performed by using combinations of asymmetrical drive signal waveforms and asymmetrical cell structures, respectively.

Eight liquid crystal cells (devices) were prepared and evaluated in the same manner as in Experimental Examples 1 and 2 except that the following combinations shown in Table 4 were adopted, respectively.

The results are shown in Table 4.

TABLE 3

| | | | | |
|---|---|---|---|---|
| 1st substrate | F | F | F | F |
| 2nd substrate | G | H | I | J |
| $f_{01}$ (kHz for S1) | 13 | 15.5 | 11 | 14 |
| $f_{02}$ (kHz for S2) | 16 | 13 | 19 | 15.5 |
| $(f_{01} - f_{02})_S$ (kHz) | −3 | +2.5 | −8 | −1.5 |
| 1st substrate | G | H | I | J |
| 2nd substrate | F | F | F | F |
| $f_{01}$ (kHz for S1) | 16 | 13 | 19 | 15.5 |
| $f_{02}$ (kHz for S2) | 13 | 15.5 | 11 | 14 |
| $(f_{01} - f_{02})_S$ (kHz) | +3 | −2.5 | +8 | +1.5 |

TABLE 4

| Waveform | B | B | B | B | C | C | D | E |
|---|---|---|---|---|---|---|---|---|
| 1st substrate | G | F | H | I | F | J | J | J |
| 2nd substrate | F | H | F | F | J | F | F | F |
| $f_{01}$ (kHz for S1) | 14.5 | 14.5 | 12 | 18 | 14.5 | 16 | 14.3 | 16 |
| $f_{02}$ (kHz for S2) | 14 | 14 | 16.5 | 11.5 | 14.2 | 12.5 | 14.5 | 12.5 |
| $(f_{01} - f_{02})$ (kHz) | +0.5 | +0.5 | −4.5 | +6.5 | +0.3 | +3.5 | −0.2 | +3.5 |

As apparent from the results shown in Table 4 in combination with those shown in Tables 2 and 3, it was found that the difference between $f_{01}$ and $f_{02}$ (i.e., $f_{01}-f_{02}$) became small by selecting a combination of a waveform and a cell structure so as to satisfy a relationship:

$$(f_{01}-f_{02})_W \times (f_{01}-f_{02})_S < 0,$$

wherein $(f_{01}-f_{02})_W$ represents a difference $(f_{01}-f_{02})$ resulting from an asymmetric waveform and $(f_{01}-f_{02})_S$ represents a difference $(f_{01}-f_{02})$ resulting from an asymmetrical cell structure.

Specifically, for example, the combination of Waveform B and the cell structure (Substrate G as 1st substrate and Substrate F as 2nd substrate) provided a decreased difference $(f_{01}-f_{02})$ of +0.5 since Waveform B provided the difference $(f_{01}-f_{02})_W$ of −2 (Table 2) and the cell structure (Substrates G and F as 1st and 2nd substrates) provided the difference $(f_{01}-f_{02})_S$ of +3 (Table 3) satisfying the above relationship.

As described hereinabove, according to the present invention, it is possible to decrease a difference in reverse frequency between two stable states by appropriately selecting a combination of an asymmetrical drive signal waveform and an asymmetrical cell structure so that the signs $(f_{01}-f_{02})_W$ and $(f_{01}-f_{02})_S$ are counterbalanced with each other. In this case, the absolute values of $(f_{01}-f_{02})_W$ and $(f_{01}-f_{02})_S$ may preferably be closer to each other. As a result, the resultant liquid crystal device can readily be driven while minimizing the liquid crystal movement since the difference $(f_{01}-f_{02})$ is minimized, so that it is possible to substantially prevent yellowing or display irregularity due to an increase in cell thickness (resulting from the liquid crystal movement), thus improving display qualities and reliability of a liquid crystal apparatus using the device.

The present invention is particularly effective in improving display qualities of a color liquid crystal apparatus including a liquid crystal device wherein only one of a pair of substrates is provided with a color filter inevitably leading to an asymmetrical cell structure by optimizing an applied asymmetrical waveform.

What is claimed is:

1. A liquid crystal apparatus, comprising:

a liquid crystal device including a pair of first and second substrates and a liquid crystal disposed between the first and second substrates, said liquid crystal being capable of having at least two stable states S1 and S2 and capable of causing a cumulative translational movement depending on a change in an external electric field applied to said liquid crystal, and means for applying an asymmetrical drive signal waveform having an effective frequency range to said liquid crystal so as to provide an absolute value of a difference between an inversion frequency $f_{01}$ where a direction of the movement of said liquid crystal is turned in an opposite direction in the state S1 and an inversion frequency $f_{02}$ where a direction of the movement of said liquid crystal is turned in an opposite direction in the state S2 smaller than a difference therebetween in the case of applying a symmetrical drive signal waveform to said liquid crystal, said inversion frequencies $f_{01}$ and $f_{02}$ being in said effective frequency range of said asymmetrical drive signal waveform.

2. An apparatus according to claim 1, wherein said difference between inversion frequencies $f_{01}$ and $f_{02}$ with respect to said asymmetrical drive signal waveform includes a first difference $(f_{01}-f_{02})_S$ resulting for an asymmetry of a device structure and a second difference $(f_{01}-f_{02})_W$ resulting from an asymmetry of said asymmetrical drive signal waveform, said first and second differences satisfying the following relationship:

$$(f_{01}-f_{02})_S \times (f_{01}-f_{02})_W < 0.$$

3. An apparatus according to claim 1, wherein said first substrate provides a first surface contacting said liquid crystal and said second substrate provides a second surface contacting said liquid crystal, said first surface having a shape different from that of said second surface.

4. An apparatus according to claim 1, wherein said first and second substrates are provided with first and second alignment control films, respectively, said first and second alignment control films being formed of materials different from each other.

5. An apparatus according to claim 1, wherein said first and second substrates are provided with first and second alignment control films, respectively, said first and second alignment control films being subjected to mutually different uniaxial aligning treatments.

6. An apparatus according to claim 1, wherein said first and second substrates are provided with first and second electrodes, respectively, said first electrodes having a shape different from that of said second electrodes.

7. An apparatus according to claim 1, wherein said liquid crystal device provides a pretilt angle of at least 10 degrees in an effective optical modulation region of said liquid crystal device.

8. An apparatus according to claim 1, wherein said liquid crystal device provides a pretilt angle of at most 5 degrees in an effective optical modulation region of said liquid crystal device.

9. An apparatus according to claim 1, wherein said liquid crystal comprises a chiral smectic liquid crystal.

10. An apparatus according to claim 1, wherein said liquid crystal comprises a ferroelectric liquid crystal.

11. A driving method for a liquid crystal device comprising a pair of substrates and a liquid crystal disposed between the substrates, said liquid crystal being capable of having at least two stable states S1 and S2 and capable of causing a cumulative translational movement depending on a change in an external electric field applied to said liquid crystal; said method comprising:

applying an asymmetrical drive signal waveform having an effective frequency range to said liquid crystal so as to provide an absolute value of a difference between an inversion frequency $f_{01}$ where a direction of the movement of said liquid crystal is turned in an opposite direction in the state S1 and an inversion frequency $f_{02}$ where a direction of the movement of said liquid crystal is turned in an opposite direction in the state S2 smaller than a difference therebetween in the case of applying a symmetrical drive signal waveform to said liquid crystal, said inversion frequencies $f_{01}$ and $f_{02}$ being in said effective frequency range of said asymmetrical drive signal waveform.

12. A method according to claim 11, wherein said asymmetrical drive signal waveform comprises a first waveform for providing the state S1 and a second waveform for providing the state S2, said first and second waveforms being mutually different in the number of a reset pulse.

13. A method according to claim 11, wherein said asymmetrical drive signal waveform comprises a first waveform for providing the state S1 and a second waveform for providing the state S2, said first and second waveforms being mutually different in pulse width of a writing pulse or reset pulse at the time of providing the states S1 and S2.

14. A method according to claim 11, wherein said asymmetrical drive signal waveform comprises a first waveform for providing the state S1 and a second waveform for providing the state S2, said first and second waveforms being mutually different in an amplitude of a writing pulse.

* * * * *

UNITED STATES PATENT AND TRADEMARK OFFICE

CERTIFICATE OF CORRECTION

PATENT NO. : 5,956,010

DATED : September 21, 1999

INVENTOR(S) : YASUFUMI ASAO ET AL.

It is certified that error appears in the above-identified patent and that said Letters Patent is hereby corrected as shown below:

ON THE COVER PAGE [56]:

FOREIGN PATENT DOCUMENTS,
"5273537" should read --5-273537--.
7056176 7-056176

COLUMN 1:

Line 53, "crystal." should read --crystal--.

COLUMN 2:

Line 59, "clarified" should read --been clarified--.

COLUMN 5:

Line 48, "electrodes)." should read --electrode).--.

COLUMN 6:

Line 56, "resulting a" should read --resulting in a --;
and
Line 62, "$(f_{01}31\ f_{02})_w$" should read --$(f_{01}-f_{02})_w$--.

COLUMN 8:

Line 4, "Cryst. $\xrightarrow{-3}$" should read
--Cryst $\xrightarrow{-3}$
Line 5, insert -- (Cryst.: crystal phase)--.

UNITED STATES PATENT AND TRADEMARK OFFICE

CERTIFICATE OF CORRECTION

PATENT NO. : 5,956,010

DATED : September 21, 1999

INVENTOR(S) : YASUFUMI ASAO ET AL.

It is certified that error appears in the above-identified patent and that said Letters Patent is hereby corrected as shown below:

COLUMN 10:

Line 27, "margin" (first occurrence) should read --margins--.

COLUMN 13:

Line 65, "rom" should read --from--.

COLUMN 14:

Line 38, "backing" should read --baking--.

Signed and Sealed this

Twelfth Day of December, 2000

*Attest:*

*Attesting Officer*

Q. TODD DICKINSON

*Director of Patents and Trademarks*